US009209578B2

(12) United States Patent
Mochizuki

(10) Patent No.: US 9,209,578 B2
(45) Date of Patent: Dec. 8, 2015

(54) CONNECTING STRUCTURE FOR ELECTRONIC DEVICES

(71) Applicant: YAZAKI CORPORATION, Tokyo (JP)

(72) Inventor: Shinji Mochizuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/895,066

(22) Filed: May 15, 2013

(65) Prior Publication Data

US 2013/0252475 A1 Sep. 26, 2013

Related U.S. Application Data

(63) Continuation of application No. PCT/JP2011/077281, filed on Nov. 18, 2011.

(30) Foreign Application Priority Data

Nov. 19, 2010 (JP) ..... 2010-259278

(51) Int. Cl.
*H01R 24/00* (2011.01)
*H01R 13/64* (2006.01)
(Continued)

(52) U.S. Cl.
CPC ..... *H01R 24/00* (2013.01); *H01R 13/64* (2013.01); *H01R 13/665* (2013.01); *H01R 13/7175* (2013.01)

(58) Field of Classification Search
CPC ..... H01R 23/7073
USPC ..... 439/660, 417, 404, 405, 460; 362/373, 362/218
See application file for complete search history.

(56) References Cited

U.S. PATENT DOCUMENTS 4,679,885 A 7/1987 Nestor et al.
7,074,093 B2 * 7/2006 Saka et al. ..... 439/724
(Continued)

FOREIGN PATENT DOCUMENTS

CN 2360989 Y 1/2000
CN 2537151 Y 2/2003
(Continued)

OTHER PUBLICATIONS

International Search Report and Written Opinion of the International Search Report for PCT/JP2011/077281 dated Feb. 23, 2012.
(Continued)

*Primary Examiner* — Phuongchi T Nguyen
(74) *Attorney, Agent, or Firm* — Kenealy Vaidya LLP

(57) ABSTRACT

In a connecting structure for electronic devices, a housing is configured to be inserted into a cover, and a terminal is accommodated in the housing to hold an electronic device inserted therein. A terminal accommodating chamber in the housing accommodates the terminal. An opening part is formed in a forward end surface of the housing in a first direction in which the housing is inserted into the cover, and communicates with the terminal accommodating chamber so that the electronic device is inserted therethrough. A positioning part is provided in the terminal accommodating chamber, and is configured to come in contact with a forward end of the electronic device in a insertion direction of the electronic device, so as to position the electronic device in the second direction.

7 Claims, 11 Drawing Sheets

(51) Int. Cl.
*H01R 13/66* (2006.01)
*H01R 13/717* (2006.01)

(56) References Cited

U.S. PATENT DOCUMENTS

| | | | | |
|---|---|---|---|---|
| 7,934,941 | B2 * | 5/2011 | Hayauchi | 439/417 |
| 2003/0077942 | A1 | 4/2003 | Givens et al. | |
| 2007/0127216 | A1 | 6/2007 | Kamiya et al. | |
| 2009/0244925 | A1 | 10/2009 | Snagel et al. | |
| 2010/0167579 | A1 | 7/2010 | Hayauchi | |
| 2013/0252469 | A1 * | 9/2013 | Mochizuki | 439/626 |
| 2013/0252483 | A1 * | 9/2013 | Mochizuki | 439/786 |

FOREIGN PATENT DOCUMENTS

| | | | |
|---|---|---|---|
| CN | 101507052 | A | 8/2009 |
| DE | 8512541 | U1 | 6/1985 |
| JP | 2007-149762 | A | 6/2007 |
| JP | 2007-184547 | A | 7/2007 |
| JP | 2008-49936 | A | 3/2008 |

OTHER PUBLICATIONS

Korean Office Action for the related Korean Patent Application No. 10-2013-7012569 dated May 27, 2014.

Chinese Office Action for the related Chinese Patent Application No. 201180055814 dated Jan. 6, 2015.

Korean Office Action for the related Korean Patent Application No. 10-2013-7012569 dated Nov. 28, 2014.

Japanese Office Action for the related Japanese Patent Application No. 2010-259278 dated Sep. 3, 2014.

Office Action from Chinese Patent App. No. 201180055814.X (Sep. 2, 2015) with English language translation thereof.

* cited by examiner

CONNECTING STRUCTURE FOR ELECTRONIC DEVICES

BACKGROUND

The present invention is related to a connecting structure for electronic devices which is connected by an insertion into a housing.

Patent Document 1 discloses a connecting structure that assuredly electrically connects electronic devices to obtain a high reliability. As shown in FIG. 14, in the connecting structure for the electronic devices, a pair of busbars 501 and 503 are attached to a housing, and a semiconductor light emitting element (LED) 505 as a light source is also attached to the housing. The busbars 501 and 503 are formed in the shapes of flat plates and are divided into two. The busbars 501 and 503 include an electric wire connecting part 507, a Zener diode connecting part 509, a resistor connecting part 511 and an LED connecting part 513. In the resistor connecting part 511, pressure contact blades 515 and 515 are provided respectively in the busbars 501 and 503. In the Zener diode connecting part 509, a single pressure contact blade 517 is provided in the one busbar 501 and a single pressure contact blade 519 is provided in the other busbar 503.

In a Zener diode 521, one lead part 523 is electrically connected to the one busbar 501 and the other lead part 525 is electrically connected to the other busbar 503 respectively, so that the Zener diode 521 is connected in parallel with the one pair of busbars 501 and 503 in the downstream side of a resistor 527. Thus, the Zener diode functions to protect the LED from a damage due to a sudden large voltage applied to a circuit by a static electricity in a direction where a forward electromotive force is supplied to the diode and to prevent a current from being supplied in a direction where a counter electromotive force is supplied to the diode and similarly protect the LED from the damage.

[Patent Document 1] JP-A-2007-149762

SUMMARY

In the related connecting structure for the electronic devices, since the Zener diode 521 is pushed in to the pressure contact blades 517 and 519 and the resistor 527 is pushed in to the pressure contact blades 515 and 515 to be held, the electronic devices is hardly constantly held at a normal position and a reliability of an electric contact is hardly improved.

It is therefore one advantageous aspect of the present invention to provide a connecting structure in which electronic devices can be constantly positioned to a normal position and a reliability of an electric connection is improved.

According to one advantage of the invention, there is provided a connecting structure for electronic devices, the connecting structure comprising:

a cover;

a housing, configured to be inserted into the cover; and a terminal, accommodated in the housing, and configured to hold an electronic device inserted therein, wherein the housing includes:

a terminal accommodating chamber accommodating the terminal;

an opening part, formed in a forward end surface of the housing in a first direction in which the housing is inserted into the cover, and communicating with the terminal accommodating chamber so that the electronic device is inserted therethrough; and a positioning part, provided in the terminal accommodating chamber, and configured to come in contact with a forward end of the electronic device in a second direction in which the electronic device is inserted into the terminal, so as to position the electronic device in the second direction.

The connecting structure may further comprise: a protruding part, protruding from an inner surface of the cover opposing to the forward end surface of the housing, configured to be inserted into the opening part to hold the electronic device with the positioning part in a state where the housing is inserted in the cover.

The connecting structure may be configured such that: the housing includes a central wall so as to define a pair of the terminal accommodating chambers sandwiching the central wall, and the positioning part is provided in an end part of the central wall opposing the forward end of the electronic device.

DETAILED DESCRIPTION OF EXEMPLIFIED EMBODIMENTS

Figure 1:
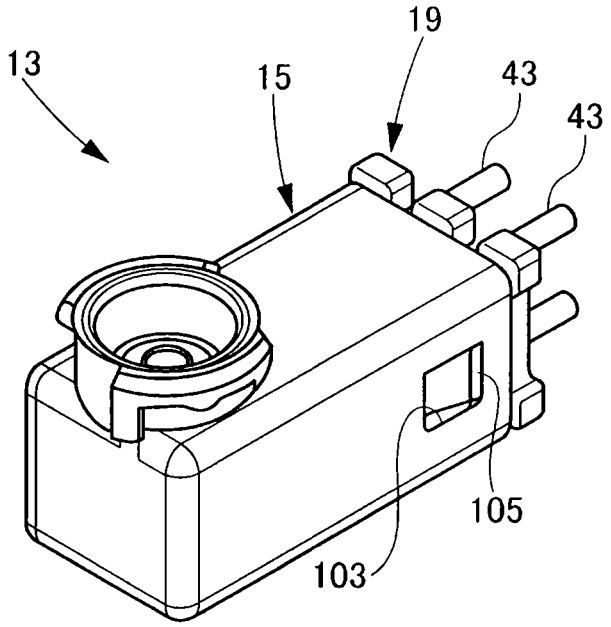
FIG. 1 is a perspective view of an LED unit having a connecting structure for electronic devices according to the present invention.

An embodiment of the present invention will be described below by referring to the drawings.

Figure 2:
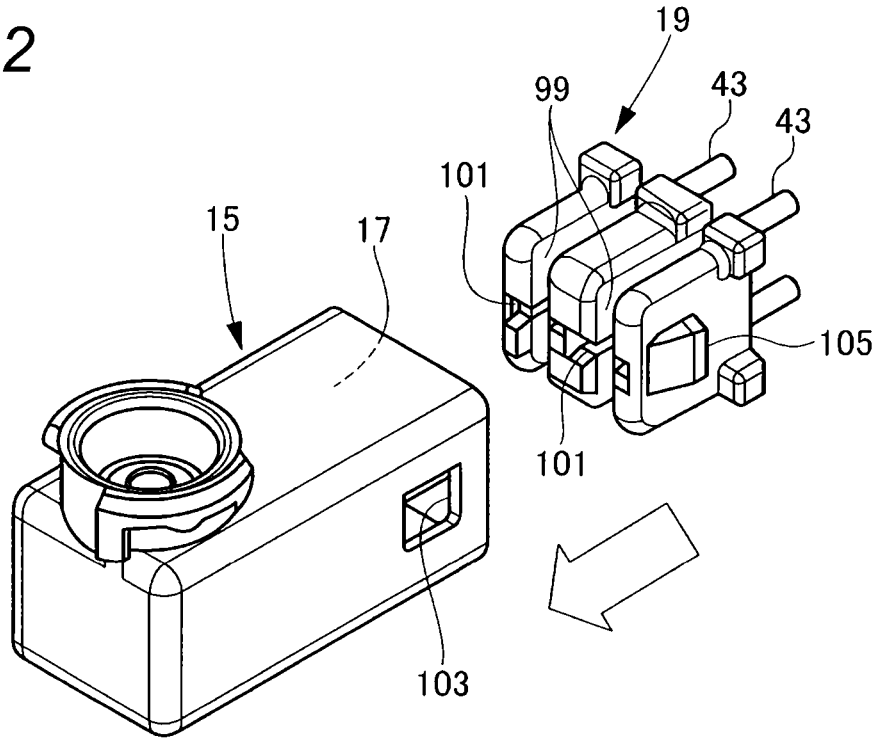
FIG. 2 is an exploded perspective view of the LED unit shown in FIG. 1 and an electric wire holder.
Figure 3:
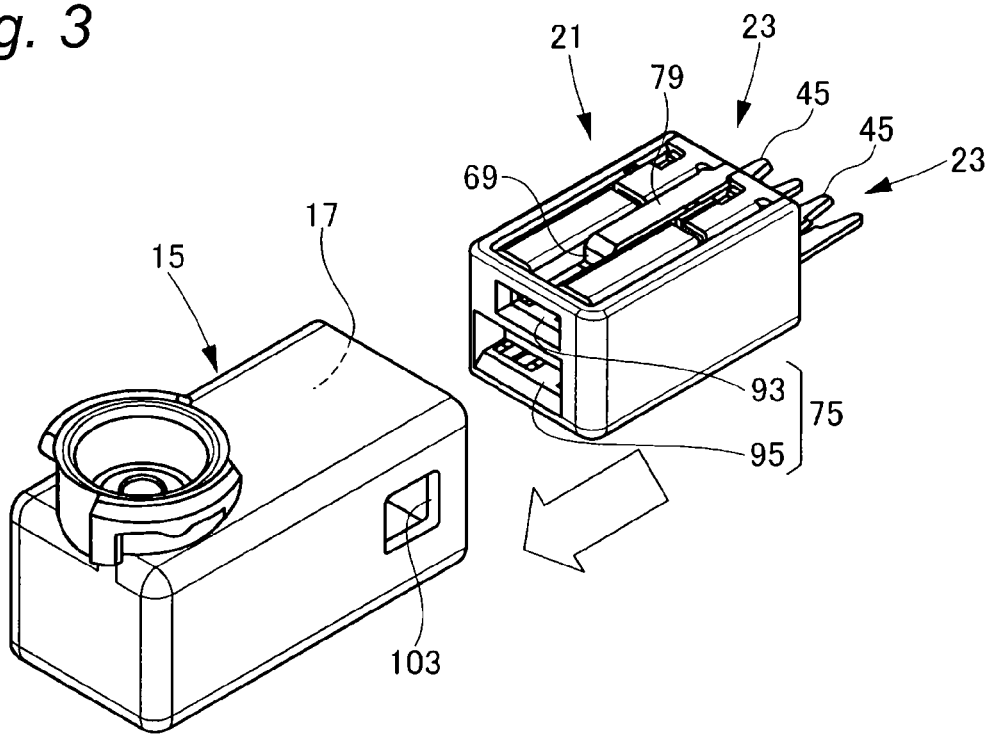
FIG. 3 is an exploded perspective view of the LED unit and a housing.

FIG. 1 is a perspective view of an LED unit having a connecting structure for electronic devices according to the present invention. FIG. 2 is an exploded perspective view of the LED unit shown in FIG. 1 and an electric wire holder. FIG. 3 is an exploded perspective view of the LED unit and a housing.

A connecting structure for electronic devices according to the present embodiment is preferably suitably used in, for example, an LED unit 13 shown in FIG. 1. The LED unit 13 has an electric wire holder 19 shown in FIG. 2 attached to a housing inserting opening 17 provided in a rear part side of a lens cover 15. In the present embodiment, the housing inserting opening 17 side of the lens cover 15 is referred to as a "rear" and an opposite side thereto is referred to as a "front". Before the electric wire holder 19 is attached to the lens cover 15, a housing 21 shown in FIG. 3 is previously attached to the lens cover 15. To the housing 21, two terminals 23 having the same form shown in FIG. 3 are attached.

Figure 4:
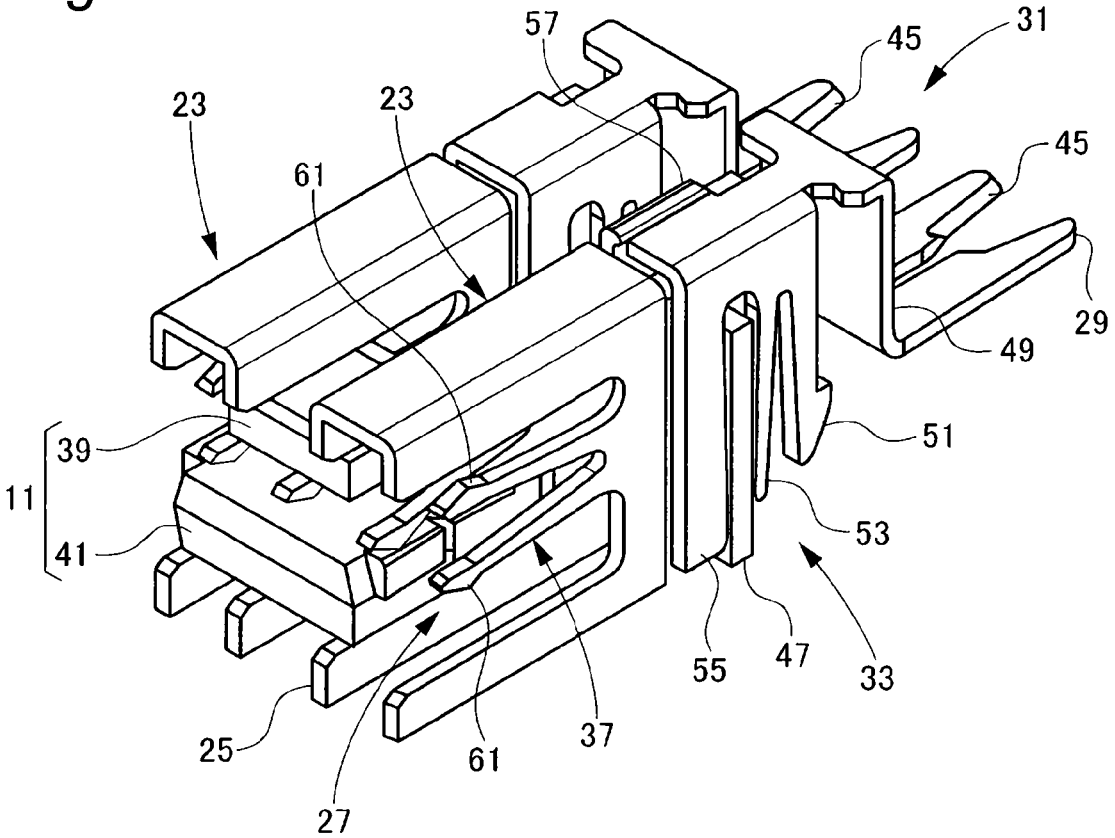
FIG. 4 is an enlarged perspective view of a terminal shown in FIG. 3.

FIG. 4 is an enlarged perspective view of the terminals 23 shown in FIG. 3.

The two terminals 23 form a first pressure contact part 27 in one end 25, a second pressure contact part 31 in the other end 29 and a third pressure contact part 33 in an intermediate part between the first pressure contact part 27 and the second pressure contact part 31, which are spaced from each other and arranged in parallel. In the first pressure contact part 27, at least one pair of main contact spring pieces 37 which can respectively come into resilient contact with pairs of contact parts of two electronic devices 11 are arranged and opposed to each other. In the present embodiment, in one terminal 23, one pair of main contact spring pieces 37 are provided. Between the two terminals, the one pair of adjacent main contact spring pieces 37 are connected to one pair of contact parts of a semiconductor light emitting element 39 as the first electronic devices 11. Further, the other pair of main contact spring pieces 37 located between the two terminals are connected to one pair of contact parts 35 of a Zener diode 41 as the second electronic devices 11.

Figure 5:
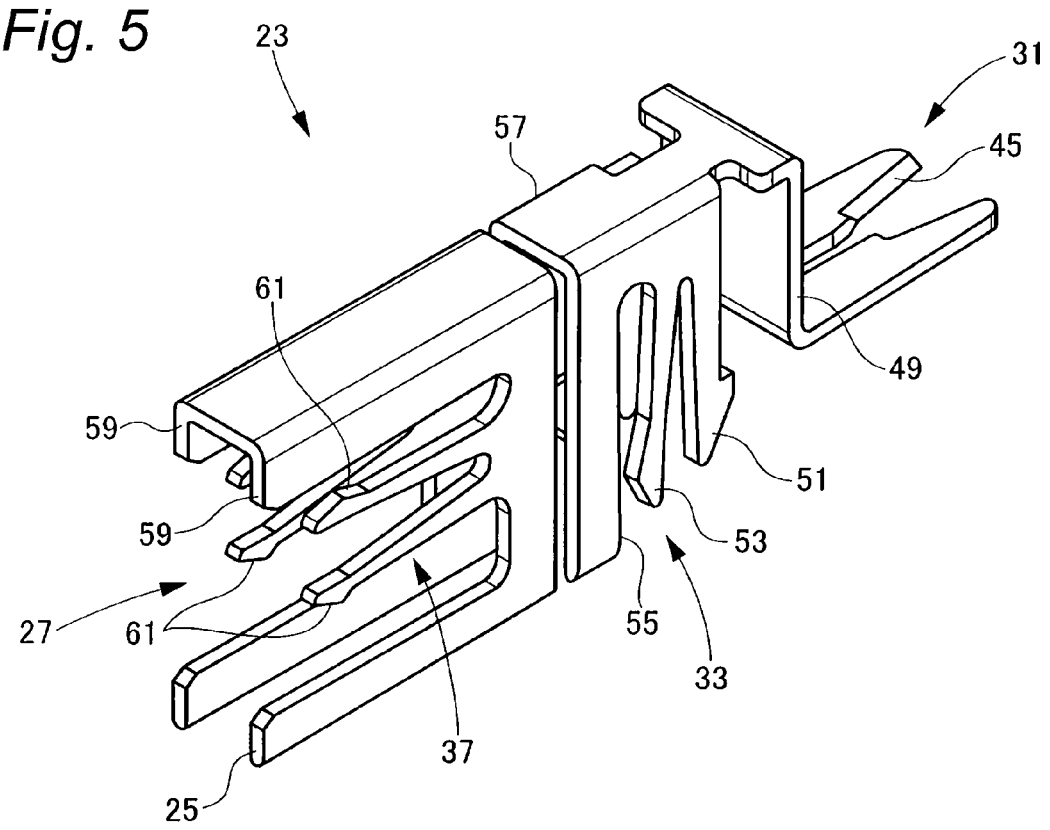
FIG. 5 is a perspective view of a single body of the terminal shown in FIG. 4

FIG. 5 is a perspective view of the one terminal 23 shown in FIG. 4.

A part of the terminal 23 protrudes to an external part of the housing 21 under a state that the terminal is attached to the housing 21. A rear end of the terminal 23 forms the above-described second pressure contact part 31. In the second pressure contact part 31, pressure contact blades 45 are provided that cut and tear a coating of a coated electric wire 43 (see FIG. 2) to come into electric contact with a conductor.

In a front part of the pressure contact blades 45, the third pressure contact part 33 is provided. Namely, in the intermediate part between the first pressure contact part 27 and the second pressure contact part 31, the third pressure contact part 33 is provided. The third pressure contact part 33 can come into pressure contact with other electronic devices 11, for instance, a resistor 47 shown in FIG. 4. In the third pressure contact part 33, a rear part abutting piece 49, a rear part resilient leg 51, an auxiliary contact spring piece 53 and a front part abutting piece 55 are connected forward from the pressure contact blades 45.

To the front part abutting piece 55 of a back surface side in FIG. 5, the first pressure contact part 27 as one end 25 of the terminal 23 is connected through a connecting part 57. The pressure contact blade 45, the rear part abutting piece 49, the rear part resilient leg 51, the auxiliary contact spring piece 53, the front part abutting piece 55 and the first pressure contact part 27 are integrally stamped by a thin plate working, and then, bent to a form shown in FIG. 5. The first pressure contact part 27 of the terminal 23 is bent in the shape of U so that a pair of side walls 59 are parallel to each other, and the main contact spring pieces 37 are stamped and formed respectively in the side walls 59. A main body of the terminal 23 is bent and formed in the shape of U and the main contact spring pieces 37 are formed in the one pair of opposed side walls 59 by a stamping work. Thus, a resiliently connecting structure having many electric contact parts 61 can be easily and compactly manufactured.

Figure 6C:
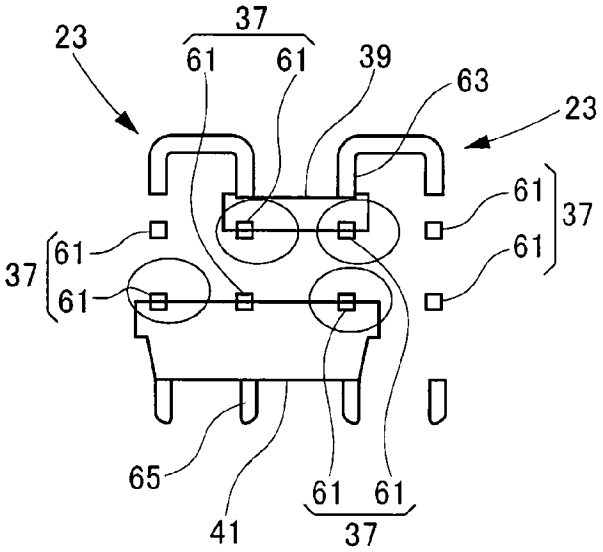
FIG. 6C is a sectional view seen from a line B-B in FIG. 6A.
Figure 6B:
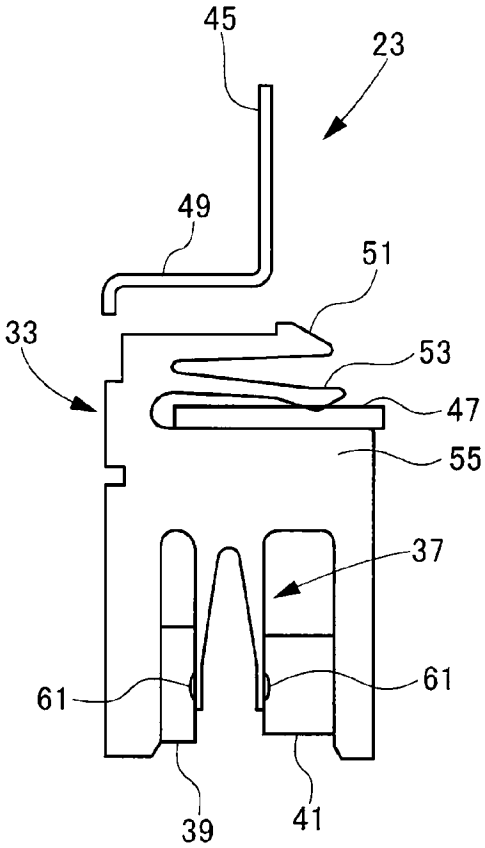
FIG. 6B is a sectional view seen from a line A-A in FIG. 6A.
Figure 6A:
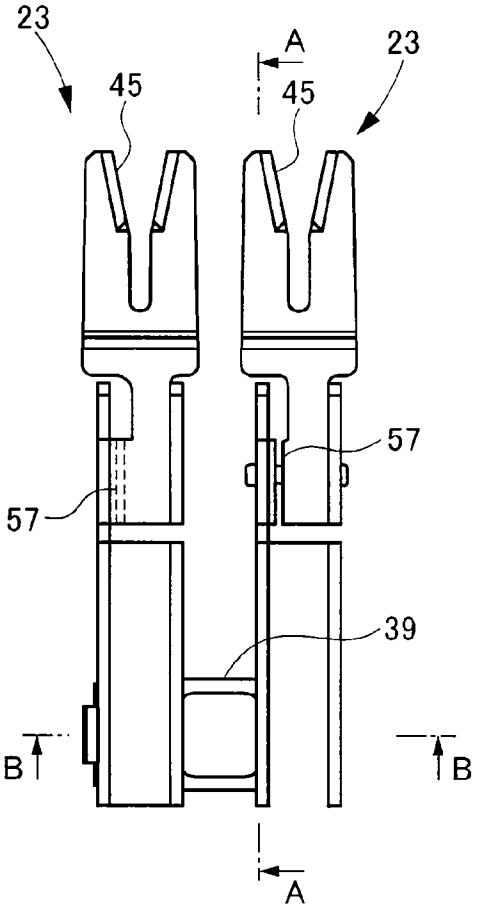
FIG. 6A is a plan view of the terminal shown in FIG. 4.
Figure 7A:
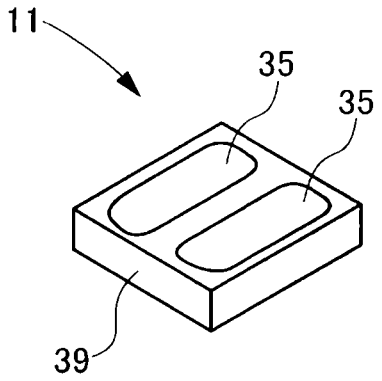
FIG. 7A is a perspective view of a semiconductor light emitting element.
Figure 7B:
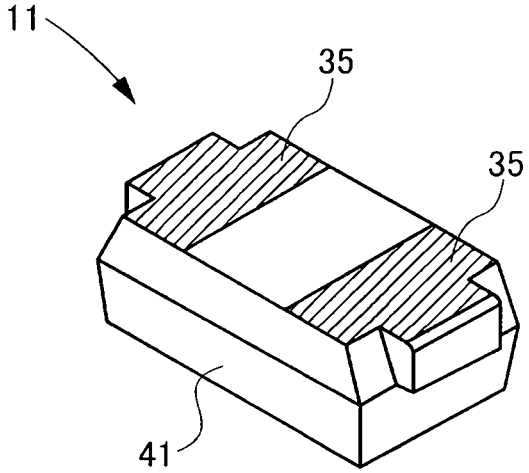
FIG. 7B is a perspective view of a Zener diode.
Figure 7C:
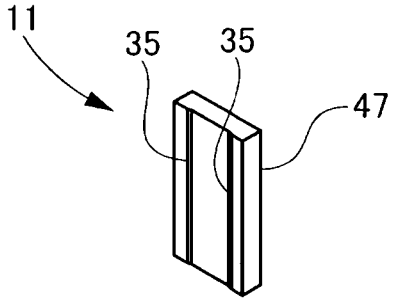
FIG. 7C is a perspective view of a resistor.

FIG. 6A is a plan view of the terminal 23 shown in FIG. 4, FIG. 6B is a view seen from a line A-A thereof, and FIG. 6C is a view seen from a line B-B thereof. FIG. 7A is a perspective view of the semiconductor light emitting element 39, FIG. 7B is a perspective view of the Zener diode 41 and FIG. 7C is a perspective view of the resistor 47.

In the one terminal 23, one pair of main contact spring pieces 37 are formed in parallel. Ends of the main contact spring pieces 37 branch substantially in the shape of Y and form the electric contact parts 61. The electric contact parts 61 are formed in triangular shapes having contacts as apex angles. As shown in FIG. 6A, the two terminals 23 are spaced from each other and arranged in parallel. Thus, as shown in FIG. 6C, the electric contact parts 61 are arranged at eight positions including four positions in each of sides. To the electric contact parts 61 at the four positions of the one side of a rear part, rear parts seat parts 63 respectively formed in the terminals 23 are opposed. Further, to the electric contact parts 61 at the four positions of the one side of a front part, front parts seat parts 65 respectively formed in the terminals 23 are opposed.

Between the rear parts seat parts 63 and the electric contact parts 61 at the four positions of the one side of the rear part, the semiconductor light emitting element 39 is mounted. Between the electric contact parts 61 at the four positions of the one side of the front part and the front parts seat parts 65, the Zener diode 41 is mounted. As shown in FIG. 7A, the semiconductor light emitting element 39 is one of the electronic devices 11 to be mounted on a surface which has the one pair of contact parts 35 provided on one surface. Further, as shown in FIG. 7B, the Zener diode 41 is also one of the electronic devices 11 to be mounted on a surface which has the one pair of contact parts 35 provided on one surface. Further, as shown in FIG. 7C, the resistor 47 is also one of the electronic devices 11 to be mounted on a surface which has one pair of contact parts 35 provided on one surface.

As shown in FIG. 6C, a surface of the semiconductor light emitting element 39 on which the contact parts 35 are provided faces to the electric contact parts 61 on an upper stage, and a back surface of the semiconductor light emitting element 39 is allowed to abut on the rear parts seat parts 63. A surface of the Zener diode 41 on which the contact parts 35 are provided faces the electric contact parts 61 side of a lower stage, and a back surface of the Zener diode 41 is allowed to abut on the front parts seat parts 65. In the present embodiment, a pitch between contacts of the semiconductor light emitting element 39 is smaller than a pitch between contacts of the Zener diode 41. Namely, the two electronic devices 11 have different pitches between contacts. In the connecting structure for the electronic devices 11, the electronic devices 11 having the different pitches between the contacts as described above can be mounted at the same time. Namely, as shown in FIG. 6C, in one side, the one pair of contact parts 35 of the semiconductor light emitting element 39 come into contact with the adjacent electric contact parts 61 of the two terminals 23. In the other side, the electric contact parts 61 of the two terminals 23 come into contact with the one pair of contact parts 35 of the Zener diode 41 by striding over at least one electric contact part 61.

In FIG. 6C, the semiconductor light emitting element 39 is connected to both of a second one of the electric contact parts 61 and a third one of the electric contact parts 61 from the left side in the upper stage. Further, the Zener diode 41 is connected to a first one of the electric contact parts 61 from a left side and the third one of the electric contact parts 61 from the left side in the lower stage. However, the Zener diode 41 may be connected to the second one of the electric contact parts 61 from the left side and a fourth one of the electric contact parts 61 from the left side. Further, in the present embodiment, the Zener diode 41 is used in which the pitch between the contacts has a distance two times as large as a pitch between contacts of the electric contact part 61, however, the Zener diode may be used in which the pitch between the contacts has a distance three times as large as the pitch between the contacts of the electric contact part 61. In this case, the one pair of contact parts 35 of the Zener diode 41 are connected to the first one of the electric contact parts 61 from the left side and the fourth one of the electric contact parts 61 from the left side.

In the connecting structure for the electronic devices 11, the semiconductor light emitting element 39 and the Zener diode 41 are connected in parallel between an anode and a cathode. In such a connecting structure for the electronic devices 11, a circuit is supposed to have the resistor 47 provided between the semiconductor element 39 and the Zener diode 41 and the anode. In such a case, in the third pressure contact part 33 of this structure, as shown in FIG. 6A, during a connection of the resistor 47, the connecting part 57 is separated between one pair of auxiliary contact spring pieces 53 which are respectively connected to one pair of contact parts 35 of the resistor 47.

Figure 8:
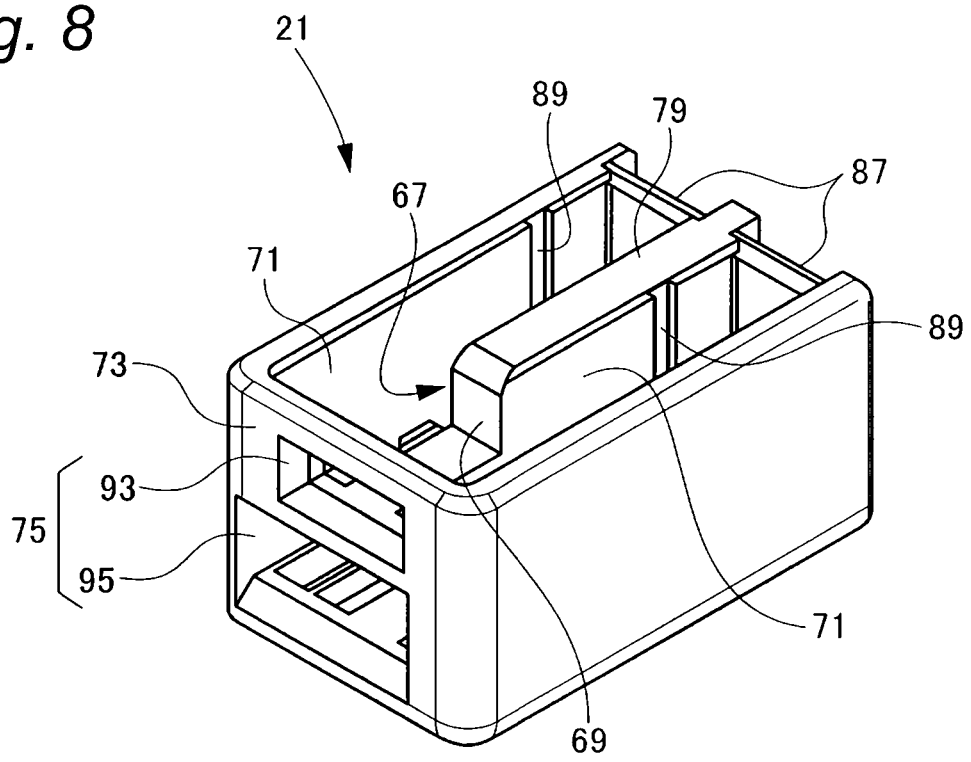
FIG. 8 is a perspective view of a housing having a positioning part formed in an end surface of a central wall.
Figure 9A:
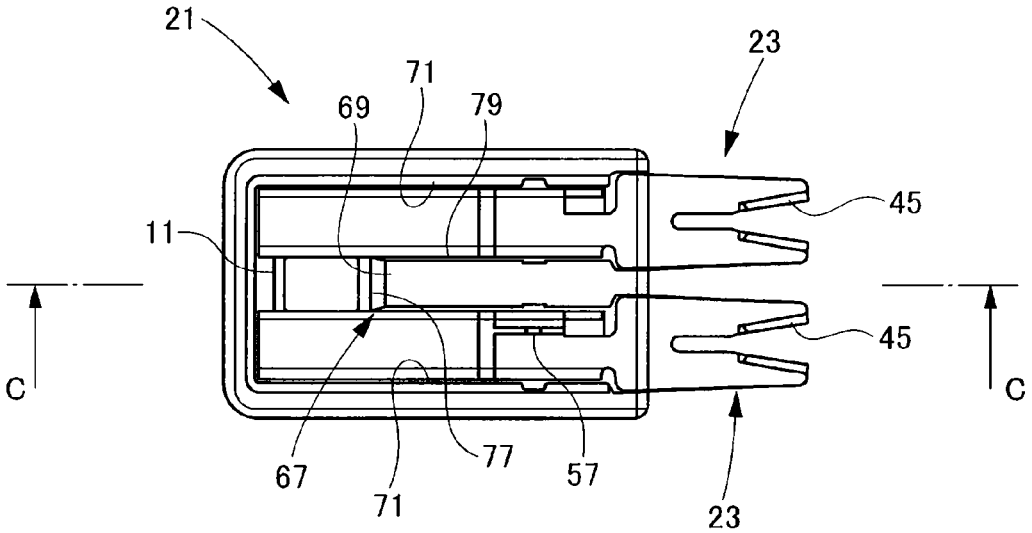
FIG. 9A is a plan view of the housing.
Figure 9B:
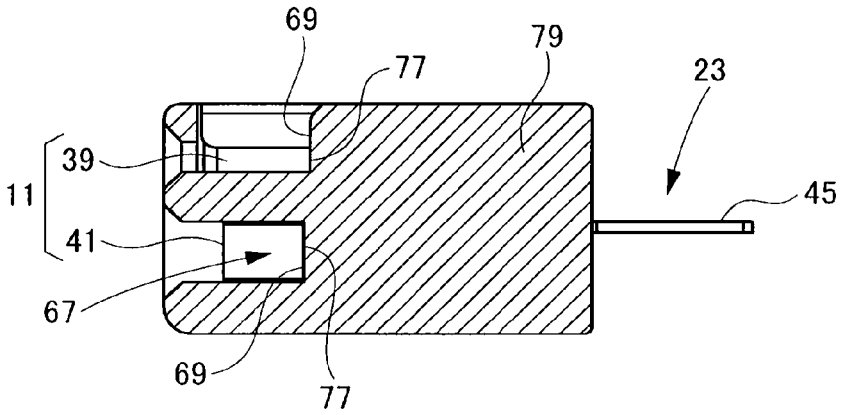
FIG. 9B is a sectional view seen from a line C-C in FIG. 9A.
Figure 10:
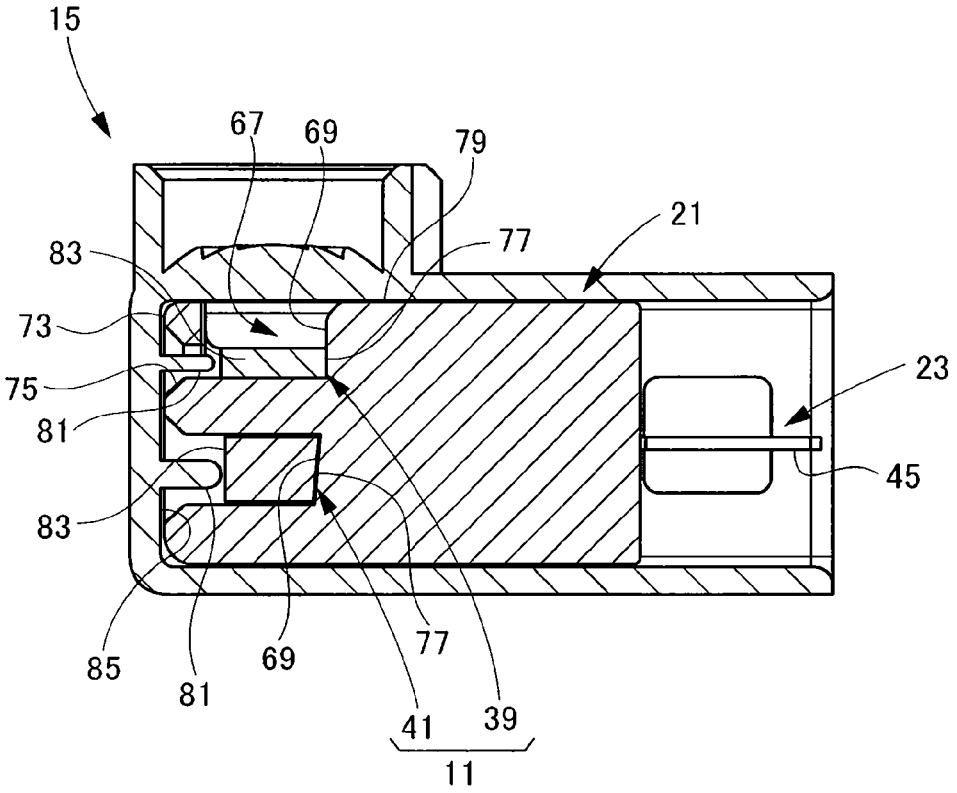
FIG. 10 is a sectional view of the housing fitted to a lens cover.

FIG. 8 is a perspective view of the housing 21 having a positioning part 69 formed in an end surface 67 of a central wall. FIG. 9A is a plan view of the housing 21 and FIG. 9B is a diagram seen from a line C-C thereof. FIG. 10 is a sectional view of the housing 21 fitted to the lens cover 15.

The housing 21 includes a terminal accommodating chamber 71 shown in FIG. 8 for accommodating the terminal 23, an electronic devices inserting opening part 75 formed in a housing end surface 73 in a fitting direction to the lens cover 15 and communicating with the terminal accommodating chamber 71 so as to insert the electronic devices 11, and a positioning part 69 provided in the terminal accommodating chamber 71 and abutting on an inserting end of the inserted electronic devices 11 to position the electronic devices 11 in an inserting direction. The inserting end of the inserted electronic devices 11 is a forward end of at least one of the electronic device 11 in a direction in which the one of the electronic devices 11 is inserted into the terminal 23.

As shown in FIG. 9, a pair of terminal accommodating chambers 71 are defined in right and left parts with a central wall 79 sandwiched between them. The positioning part 69 is provided in the end surface 67 of the central wall opposed to the inserting end 77 of the electronic devices 11 in the central wall 79. By using the central wall 79 for insulating and separating the one pair of terminals 23 arranged in the right and left parts, the positioning part 69 is formed in the end surface 67 of the central wall. Thus, an exclusive positioning part for positioning the electronic devices 11 in the inserting direction does not need to be formed, so that the structure of the housing is made to be compact.

As shown in FIG. 10, in the present embodiment, a protruding part 81 protrudes in the lens cover 15. The connecting structure according to the invention may omit the protruding part 81. In that case, an inserting rear part 83 of the electronic devices 11 is allowed to directly abut on a fitting interior wall 85 of the lens cover 15. In the present embodiment, since the protruding part 81 is provided in the fitting interior wall 85 of the lens cover 15, when the electronic devices 11 having the same length are used, an entire length of the terminal accommodating chamber 71 in the inserting direction of the electronic devices is set to be larger by a protruding length of the protruding part 81.

A protruding part 81 is provided in a fitting interior wall 85 of the cover that is opposed to the electronic devices inserting opening part 75 of the housing 21 when the housing 21 is fitted to the cover. The protruding part 81 protrudes toward the housing 21. When the housing 21 is fitted to the lens cover 15, the protruding part 81 enters the electronic devices inserting opening part 75 to abut on the inserting rear part 83 of the electronic devices 11 to hold the electronic devices 11 between the positioning part 69 and the protruding part 81. Thus, in the electronic devices 11, the inserting end 77 abuts on the positioning part 69 and the inserting rear part 83 abuts on the protruding part 81 to assuredly fix front and rear parts in the inserting direction and improve a reliability of an electric connection to the terminals 23.

An attaching process of the connecting structure for the electronic devices 11 having the above-described structure will be described below.

Figure 11:
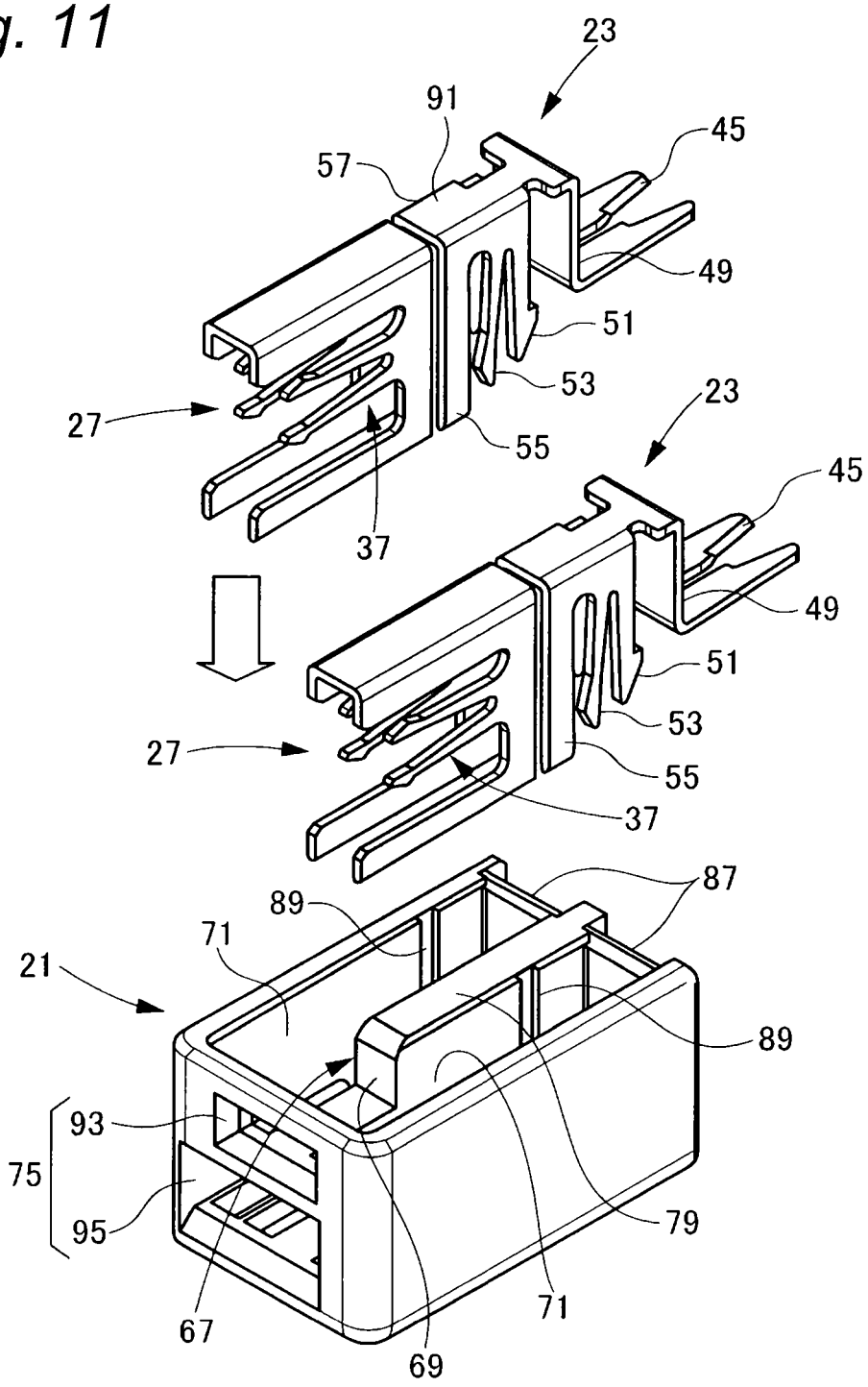
FIG. 11 is an attaching process diagram of the terminal.
Figure 12:
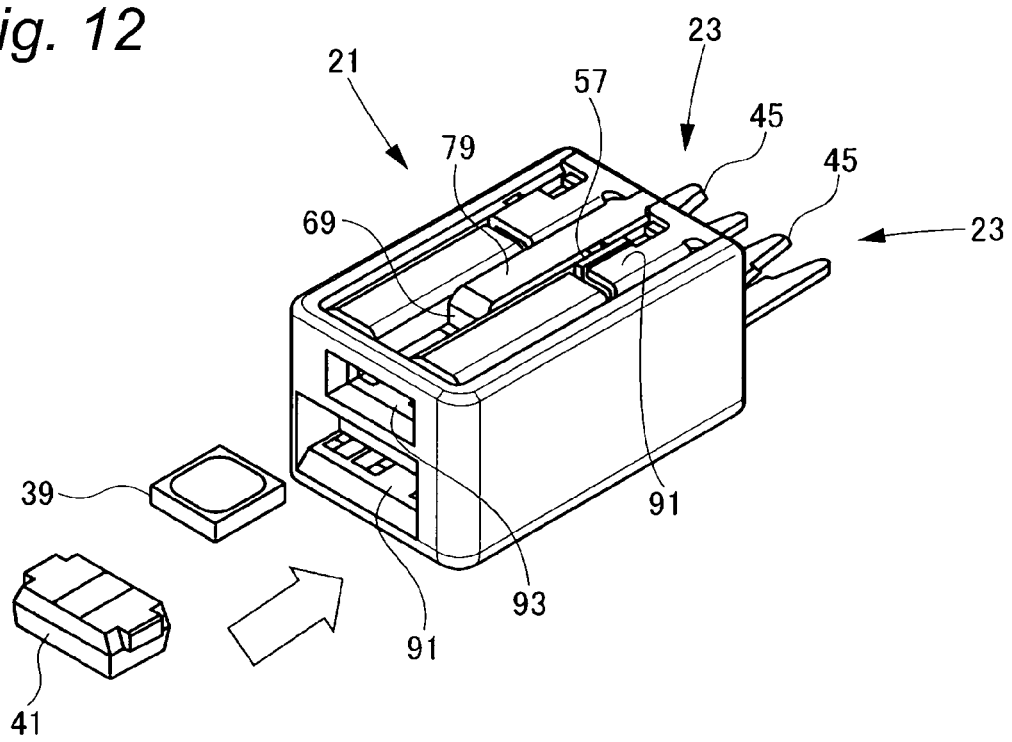
FIG. 12 is an attaching process diagram of the electronic devices.
Figure 13:
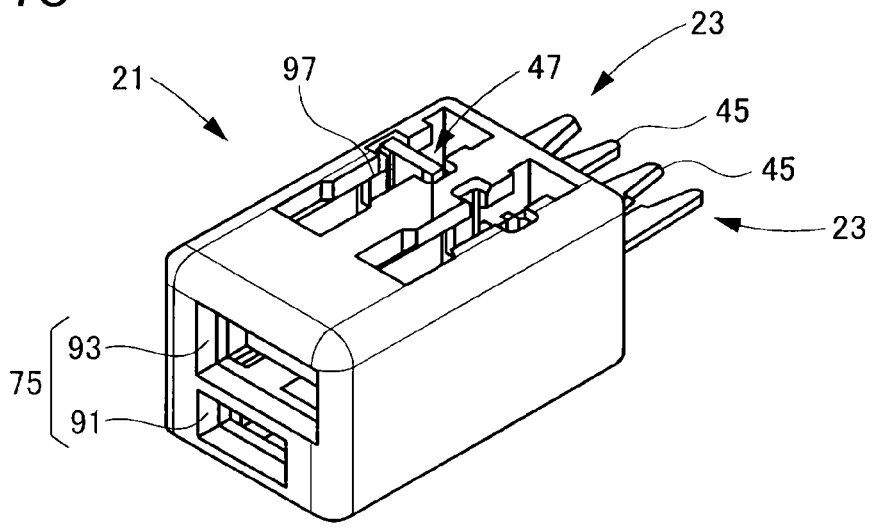
FIG. 13 is an attaching process diagram of the resistor.
Figure 14:
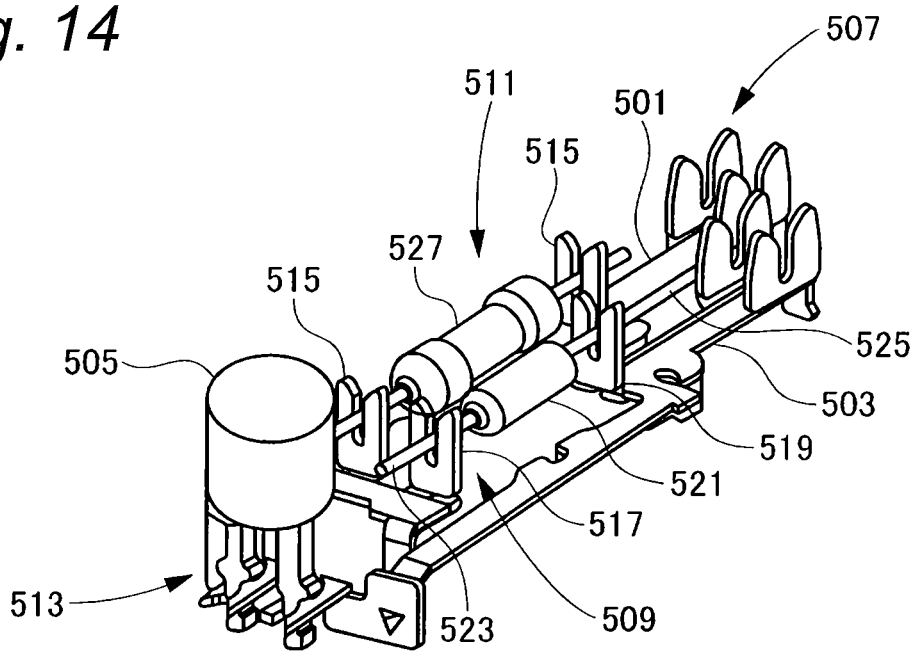
FIG. 14 is a perspective view of a related connecting structure for electronic devices.

FIG. 11 is an attaching process diagram of the terminal. FIG. 12 is an attaching process diagram of the electronic devices. FIG. 13 is an attaching process diagram of the resistor.

In order to assemble the LED unit 13, as shown in FIG. 11, the two terminals 23 are attached to the housing 21. In the housing 21, the two terminal accommodating chambers 71 are formed. The terminal accommodating chambers 71 have rear ends as rear walls 87. On inner wall surfaces of front parts of the rear walls 87, one pair of holding grooves 89 are respectively formed in the terminal accommodating chambers 71. The terminal 23 inserted into the terminal accommodating chamber 71 holds the rear wall 87 between the rear part abutting piece 49 and the rear part resilient leg 51 to restrain the terminal from slipping out from the housing 21 and complete the attachment of the terminal 23.

As shown in FIG. 12, when the terminals 23 are attached to the housing 21, the connecting part 57 of the one terminal 23 is cut. The terminal 23 inserted into the terminal accommodating chamber 71 has the connecting part 57 located in a front surface 91 in an inserting direction. Thus, whether or not the connecting part 57 is cut in a cut area can be easily recognized by visually recognizing the front surface 91 in the inserting direction from an inserting side of the terminal accommodating chamber 71.

On a front surface of the housing 21, an LED attaching opening part 93 and a diode attaching opening part 95 of the electronic devices insetting opening part 75 are formed in two upper and lower stages. Into the LED attaching opening part 93, the semiconductor light emitting element 39 is inserted with the contact parts 35 directed downward. Into the diode attaching opening part 95, the Zener diode 41 is inserted with the contact parts 35 directed upward. Thus, as shown in FIG. 6C, the contact parts 35 are respectively connected to their electric contact parts 61.

As shown in FIG. 13, after the semiconductor light emitting element 39 and the Zener diode 41, the resistor 47 is inserted. The resistor 47 is inserted with both edge parts guided by the holding grooves 89 from a bottom plate opening part 97, so that the contact parts 35 are respectively connected to the one pair of auxiliary contact spring pieces 53.

The housing 21 in which the attachment of the electronic devices 11 is completed is inserted into the lens cover 15 with the electronic devices inserting opening part 75 located forward as shown in FIG. 3. The housing 21 inserted into the lens cover 15 has the pressure contact blades 45 protruding rearward in the lens cover 15.

Into the lens cover 15 to which the housing 21 is attached, the electric wire holder 19 is inserted from the housing inserting opening 17 as shown in FIG. 2. In three outer surfaces of the electric wire holder 19, U shaped electric wire holding grooves 99 are formed at two positions. To the electric wire holding grooves 99, the coated electric wires 43 are respectively bent in the shapes of U and attached. On a front surface of the electric wire holder 19, horizontal pressure contact blade entering slits 101 are formed which respectively extend over the electric wire holding grooves 99. Thus, when the electric wire holder 19 is inserted into the lens cover 15, the pressure contact blades 45 protruding rearward in the lens cover 15 enter the pressure contact blade entering slits 101 to connect the pressure contact blades 45 to the conductors of the electric wires 43.

In the electric wire holder 19 inserted into the lens cover 15, an engaging pawl 105 protruding in a side surface is engaged with an engaging hole 103 formed in a side part of the lens cover 15 to regulate the disengagement of the housing 21 and the electric wire holder itself from the lens cover 15. As a result, the housing 21 is arranged in a prescribed position between the fitting interior wall 85 of the lens cover 15 and the electric wire holder 19. A distance between the fitting interior wall 85 and the electric wire holder 19 is set to be fixed by engaging the engaging hole 103 with the engaging pawl 105. Thus, a distance between the protruding part 81 and the positioning part 69 is also fixed, so that the semiconductor light emitting element 39 and the Zener diode 41 mounted between them are positioned in prescribed positions. In such a way, the housing 21 and the electric wire holder 19 are attached to the lens cover 15 to finish the assembly of the LED unit 13 shown in FIG. 1.

As described above, in the connecting structure for the electronic devices 11, when the electronic devices 11 are inserted into the housing 21 from the electronic devices inserting opening part 75 and the housing 21 is fitted to the lens cover 15, if the inserting rear part 83 of the electronic devices 11 protrudes from the electronic devices inserting opening part 75, the inserting rear part is pressed by the fitting interior wall 85 of the lens cover 15 and the electronic devices 11 is pushed in to the terminal accommodating chamber 71. Thus, the inserting end 77 of the electronic devices 11 abuts on the positioning part 69 of the terminal accommodating chamber 71 to position the electronic devices 11 to a normal position and stabilize an electric connection of the terminal 23 and the electronic devices 11.

Accordingly, in the connecting structure for the electronic devices 11 of the present embodiment, the electronic devices 11 can be constantly positioned to a normal position and the reliability of an electric connection can be improved.

According to the connecting structure of the present invention, when the electronic devices are inserted into the housing from the electronic devices inserting opening part and the housing is fitted to the cover, if an inserting rear end of the electronic devices protrudes from the electronic devices inserting opening part, the inserting rear end is pressed by a fitting interior wall of the cover and the electronic devices is pushed in to the terminal accommodating chamber. Thus, the inserting end of the electronic devices abuts on the positioning part of the terminal accommodating chamber to position the electronic devices to a normal position and stabilize an electric connection of the terminal and the electronic devices.

According to the connecting structure of the present invention, when the electronic devices is inserted into the housing from the electronic devices inserting opening part and the housing is fitted to the cover, the protruding part protruding from the fitting interior wall of the cover enters the electronic devices inserting opening part to press the inserting rear end of the electronic devices. Thus, in the electronic devices, the inserting rear part abuts on the protruding part and the inserting end abuts on the positioning part to assuredly fix front and rear parts in the inserting direction and improve a reliability of an electric connection to the terminal.

According to the connecting structure of the present invention, by using the central wall for insulating and separating the one pair of terminals arranged in the right and left parts, the positioning part can be formed in the end surface of the central wall. Thus, an exclusive positioning part does not need to be formed, so that the structure of the housing can be made to be compact.

The present application is based on Japanese Patent Application No. 2010-259278 filed on Nov. 19, 2010, the contents of which are incorporated herein by way of reference.

The present invention is extremely useful to provide a connecting structure in which electronic devices can be constantly positioned to a normal position and the reliability of an electric connection can be improved.

What is claimed is:

1. A connecting structure for electronic devices, the connecting structure comprising:

a cover;

a housing, configured to be inserted into the cover; and a terminal, accommodated in the housing, and configured to hold an electronic device inserted therein, wherein the housing includes:

a terminal accommodating chamber accommodating the terminal;

an opening part, formed in a forward end surface of the housing in a first direction in which the housing is inserted into the cover, and communicating with the terminal accommodating chamber so that the electronic device is inserted therethrough, the terminal accommodating chamber and the opening part being configured to enable the electronic device to be inserted into the terminal accommodating chamber via the opening part along a second direction that is substantially opposite to the first direction such that the electronic device is retained within the terminal accommodating chamber prior to the housing being inserted into the cover; and a positioning part, provided in the terminal accommodating chamber, and configured to come in contact with a forward end of the electronic device in the second direction in which the electronic device is inserted into the terminal, so as to position the electronic device in the second direction.

2. The connecting structure as set forth in claim 1, further comprising:

a protruding part, protruding from an inner surface of the cover opposing to the forward end surface of the housing, configured to be inserted into the opening part to hold the electronic device with the positioning part in a state where the housing is inserted in the cover.

3. The connecting structure as set forth in claim 1, wherein the housing includes a central wall so as to define a pair of the terminal accommodating chambers sandwiching the central wall, and the positioning part is provided in an end part of the central wall opposing the forward end of the electronic device.

4. The connecting structure as set forth in claim 1, wherein the opening part is contained within the cover if the housing is inserted into the cover.

5. The connecting structure as set forth in claim 1, wherein the second direction is opposite the first direction.

6. A connection structure for electrical devices, the connection structure comprising:

a cover;

a housing, configured to be inserted into the cover;

a terminal, accommodated in the housing, and configured to hold an electronic device inserted therein;

wherein the housing includes:

a terminal accommodating chamber accommodating a part of the terminal which holds and is electrically connected to an electronic device;

an opening part, formed in the forward end surface of the housing in a first direction in which the housing is inserted into the cover, and communicating with the terminal accommodating chamber so that the electronic device is inserted therethrough, the terminal accommodating chamber and the opening part being configured to enable the electronic device to be inserted into the terminal accommodating chamber via the opening part along a second direction that is substantially opposite to the first direction such that the electronic device is retained within the terminal accommodating chamber prior to the housing being inserted into the cover.

7. The connection structure as set forth in claim 6, wherein the housing includes a positioning part, provided in the terminal accommodating chamber, and configured to come into contact with a forward end of the electronic device to be inserted in the second direction into the terminal, so as to position the electronic device in the second direction.

* * * * *